US005941779A

United States Patent [19]

Zeiner-Gundersen

[11] Patent Number: 5,941,779

[45] Date of Patent: Aug. 24, 1999

[54] GOLF CLUB SWING TRAINING DEVICE

[76] Inventor: Dag H. Zeiner-Gundersen, P.O. Box 46301, Houston, Tex. 77056-8301

[21] Appl. No.: 09/048,475

[22] Filed: Mar. 26, 1998

[51] Int. Cl.[6] ..... A63B 69/36

[52] U.S. Cl. ..... 473/224

[58] Field of Search ..... 473/223, 224

[56] References Cited

U.S. PATENT DOCUMENTS 5,332,225 7/1994 Ura ..... 473/223

*Primary Examiner*—George J. Marlo

*Attorney, Agent, or Firm*—Russell J. Egan

[57] ABSTRACT

A device for improving the performance of a golfer, particularly the repetitive correct swinging of the club, is preferably mounted on a standard golf club shaft, in place of a conventional head, but alternatively could be made to be temporarily attached to the head or shaft of any standard golf club. The subject device has a housing containing two directional gyros, a power source, a set of sensors, and a like set of alarms responsive to the sensors to give an audible and/or tactile alarm when the golfer's swing is outside that of each directional gyro's predetermined and set rotating direction.

11 Claims, 2 Drawing Sheets

GOLF CLUB SWING TRAINING DEVICE

BACKGROUND OF THE INVENTION

1. The Field of the Invention

The present invention relates to a device for teaching a golfer to have the proper swinging motion with a golf club and, in particular, to a training club that will sense any incorrect swing and, through audible and tactile signals, correct the incorrect swinging motion.

2. The Prior Art

The popularity of the game of golf has produced a wide variety of gadgets which are intended to train a golfer to have the correct swinging motion with a golf club from starting with addressing the ball through, and including, the follow through. These gadgets can be generally classified into two categories. The first is a body restraint which is some form of harness placed on the golfer's person allowing only limited movement, which movement is supposedly the correct movement for the desired swing. The theory is that the golfer will train while wearing this and learn the correct swinging motion. The problem with this type of device is that the golfer can exert effort against the restrain, while training, and therefor does not necessarily learn the correct motion. In this instance, when the restrain is removed, the golfer continues to exert the same effort which results in a distorted swinging motion and a poor shot. Such devices are cumbersome to put on and therefor are not conducive to use for a practice swing on the course immediately prior to taking a scoring shot. The second type of gadget is one which controls the motion of the club. This is usually some form of guide rails which restrict the club movement, rather than the golfer, to the supposed desired path of the club head. Again the problem is that the golfer gets used to relying upon the gadget for club control rather than learning the correct swing for himself. This second type of gadget is usually of sufficient structure that it is not readily portable. Clearly it could not be carried onto a golf course and used for a practice swing immediately prior to taking a scoring shot.

The present invention is intended to overcome the above noted problems of both types of prior art devices by providing a club, or an attachment for a club, which can be carried onto the course and used for a practice swing immediately prior to taking up a club for a scoring swing. The subject invention is a golf swing trainer, in one embodiment, having a golf club shaft with a handgrip on one end and the opposite end provided with at least one directional gyro and sensors which will trigger either or both audible and/or tactile indicators of a swinging motion of the club out of the correct path. As an alternative embodiment, the subject invention could be formed an a unit attachable to the shaft of a standard golf club.

SUMMARY OF THE INVENTION

The present invention concerns a device for improving the performance of a golfer, particularly the repetitive correct swinging of the club. The device is typically mounted on a standard golf club shaft, in place of a conventional head, but alternatively could be made to be temporarily attached to the head or shaft of any standard golf club. The subject device comprises a housing containing a directional gyro, a power source, a set of sensors, and a like set of alarms responsive to the sensors to give an audible and/or tactile alarm when the golfer's swing is outside that of the directional gyro's predetermined and set rotating direction.

The subject device addresses the problem a golfer has in achieving a correct and reparative golf swing which will allow him to hit the golf ball properly. The essence to a good shot lays in the performance of the swing to ensure that the swing follows a consistent path starting with addressing the ball to hitting the ball and the follow through. During the back swing and the forward swing, the club should follow the exact same path. The present invention addresses this problem by providing a device that will guide the golfer through the feel of the club and by audio and/or tactile alarms that will alert him if he, for any reason, is not following the proper path during his back swing as well as in his forward swing to hit the ball. The device is mounted in a housing which is attached to a golf club shaft and preferably resembles the weight and feel of a conventional golf club. This housing representing the golf club head may either be attached to an existing golf club or to a standard golf club shaft. The device has at least one gyro each one of which incorporates a relatively heavy wheel that rotates at a relative high speed. The rotation of the wheels are maintained by means of a battery powered electrical motors. An adjustment system allows the wheels to be oriented in any direction to allow the golfer to set one wheel in such that it will have it's rotating axis perpendicular to the path of the swing and another wheel with it's axis parallel to the path of the swing. When the wheels are set in high speed rotation, the golfer may swing or move the club head along the natural path, with the wheel acting as a gyro, but he may not move the club head out of it's natural path without applying a sideways force against the gyro. The device is additionally equipped with at least one motion sensor element and associated alarm which will provide an indication of when the golfer moves the subject device out of it's natural path. Preferably the alarm will emit different sounds or senses if it is moved outward from the golfer versus moved inward towards the golfer. The audible alarm could also be sent to the golfer via a headset and/or to a golf pro via radio. The object is to ensure that the golfer learns to maintain a natural and correct swing without bringing the golf club head or shaft out of a position which will impair the possibility of hitting the ball correctly. The device must have sufficient ruggedness to withstand the forces generated during the swing as well as those generated by striking the ball, which may be a standard ball, training ball or the like.

BRIEF DESCRIPTION OF THE DRAWINGS

The present invention will now be described, by way of example, with reference to the accompanying drawings, in which.

DETAILED DESCRIPTION OF AN EMBODIMENT OF THE PRESENT INVENTION

Figure 1:
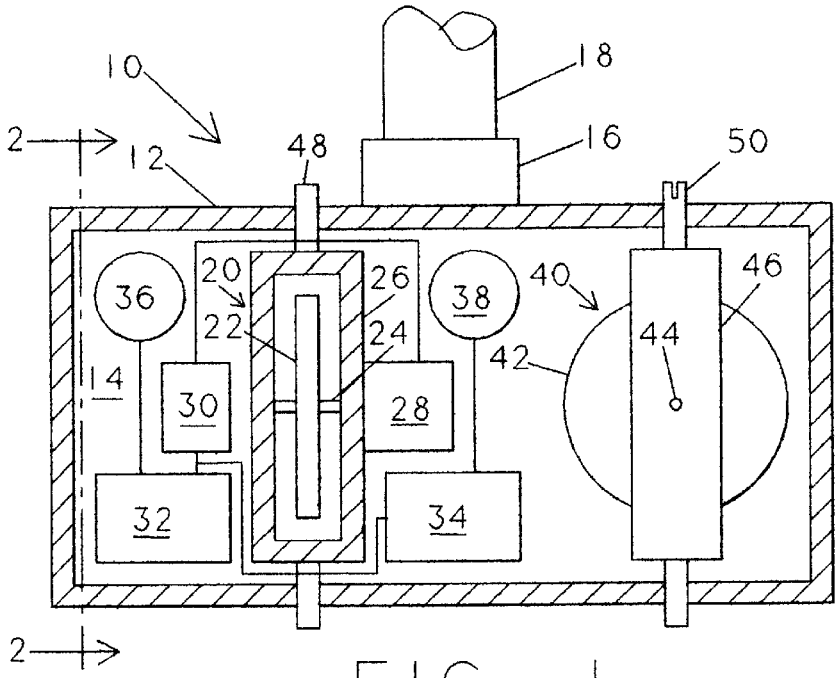
FIG. 1 is a side elevation of one embodiment of the subject invention with the cover removed.
Figure 2:
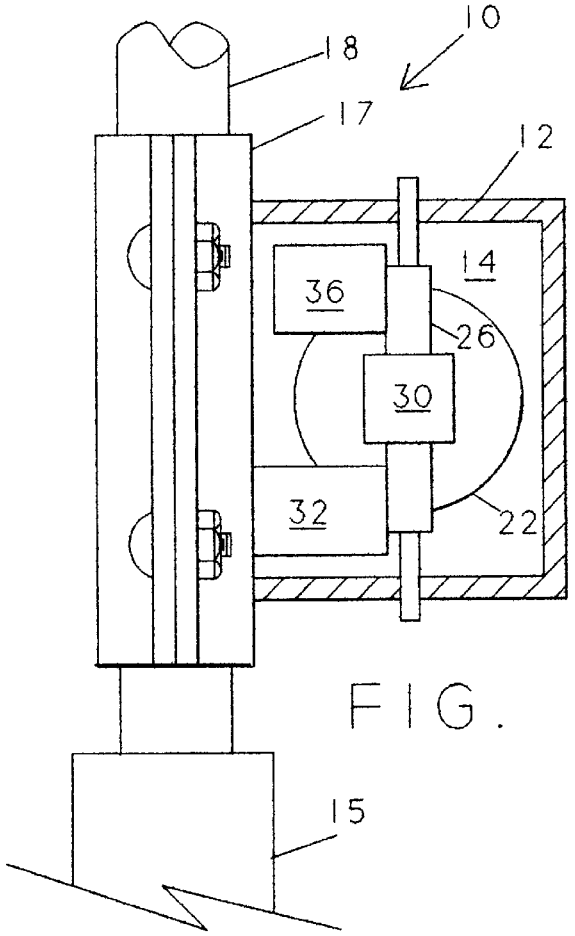
FIG. 2 is and end elevation taken along line 2—2 of FIG. 1.

The subject device 10 has a housing 12 defining a cavity 14 therein. Fixed to the exterior of the housing is an attachment means 16 which is capable of securing the device to the end of a golf club shaft 18 in place of any standard club head. Alternatively, an attachment means 17 could be used (see FIG. 2) to secure the device to any standard club, preferably closely adjacent the head 15 thereof, as shown in FIG. 2. The housing would preferably have a more aerodynamic design and could even be made to simulate a standard club head. The attachment means 17 (FIG. 2) may be selected from any of the well known means for attaching an article to a shaft including, but not restricted to, a pipe clamp, mirror image interdigitated plates, and matching plates joined together along one side by a hinge and secured together on the other side by bolts, wing nuts, screws or the like. A single axis first gyro 20 is mounted in the cavity 14 and includes a fly wheel 22 mounted for rotation about axle 24 in an adjustable frame or gimbal 26 and driven by an electric motor 28 powered from battery 30. The axis of this first gyro is parallel to the path of the club, when it is swung, so that the fly wheel is perpendicular to this path. First and second sensors 32, 34 are each connected to the battery 30 and to first and second alarm means 36, 38, respectively. A second single axis gyro 40 is mounted in the cavity 14 and includes a fly wheel 42 mounted for rotation about axle 44 in an adjustable frame or gimbal 46 and driven by an electric motor (not shown) powered from battery 30. The second gyro is mounted with its axis perpendicular to that of the first gyro so that the fly wheel mounted thereon lies parallel to the path of swinging the club. The electrical circuitry also includes an on-off switch (not shown). Known adjustment means, such as the screw adjustments 48, 50, respectively are used to adjust the axial alignment of the wheels 22 and 42 with respect to each other and to the direction of swing. Such means are also well known and can include any of a variety of springs, levers and screws adapted to angularly position the axles 24, 44 of the wheels by adjustment of the frames 26, 46.

The first and second alarm means 36,38 preferably include an audible alarm and a tactile alarm, respectively, so that the golfer can both hear and feel when his swing is improper. The audible alarm preferably generates different tones for different out-of-path conditions and could be sent to the golfer via headphones and/or via radio to a golf pro observing the golfer. The tactile alarm would preferably generate distinctive vibrations to alert the golfer to the fact that the swing is improper. This should prove to be an assistance to the effect of the spinning gyros as to the direction of the out-of-tolerance condition making corrective action easier.

Figure 3:
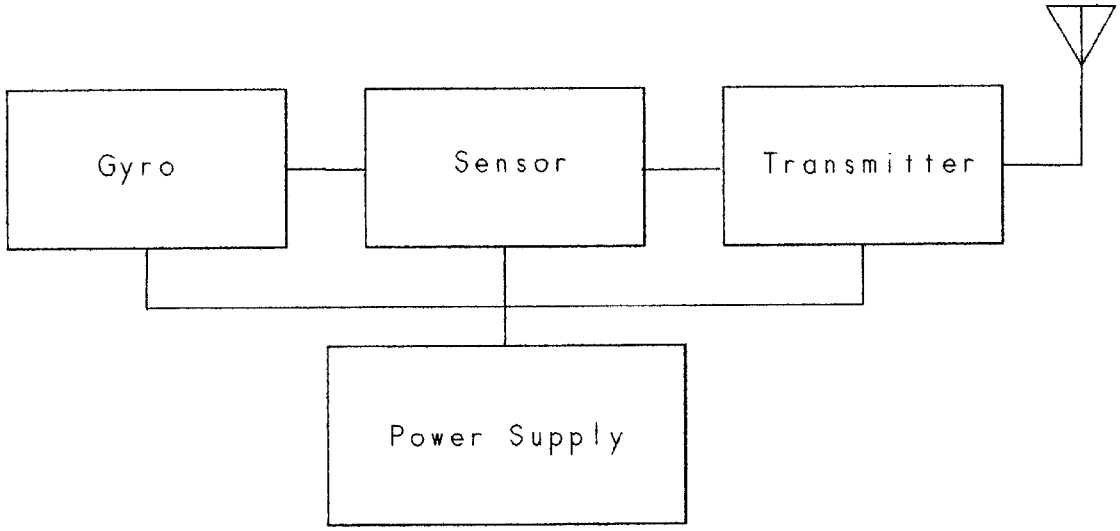
FIG. 3 is a block level schematic for broadcasting the gyro data.
Figure 4:
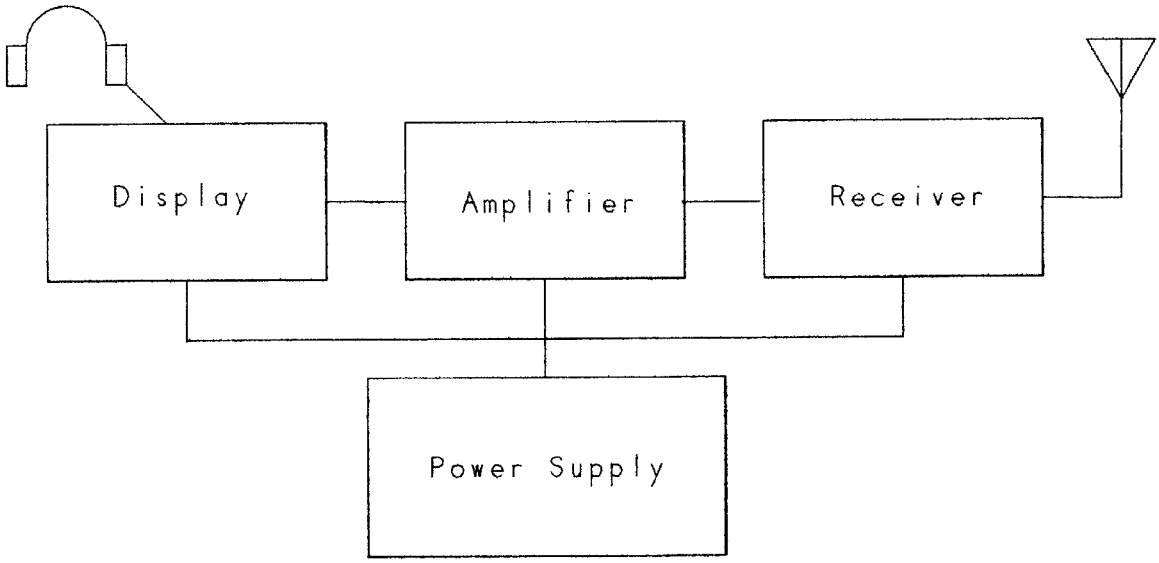
FIG. 4 is a block level schematic for a receiver for the broadcast data.

The device is similar to a golf club in size, weight and feel, but will, when used, give the golfer immediate information as to how proper his swing is his club as he moves his club through the back swing as will as if he is following the same path during the forward swing and hitting the ball. The golfer will sense, through the shaft, how well he is swinging and may also optionally leave the audio alarm on. The sensation is caused by the means of force information provided through the shaft. The effect is generated by the high weight and speed of the gyro which resist any movements out of rotating path. Any force applied through the golf club shaft by the golfer will be resisted by gyro which will attempt to maintain it's original swinging direction it was started at. This will be sensed by the golfer through the shaft. The gyro is so arranged inside the housing that it will maintain it's normal spinning direction if the golf club is swung in an ideal curvature to finally achieve the proper hit onto the ball. Optionally the golfer may also utilize the alarm system which gives a distinct sound when the golfer swings the club too far out from him while an other sound will be generated when the golf club is swung too close to the golfer. It is also within the scope of the invention to include means, such as schematically shown in FIG. 3, to send the alarm data via a radio link to a headset receiver, such as schematically shown in FIG. 4, worn by the golfer, a display unit for a golf pro observing the golfer, or both.

The present invention may be subject to many modifications and changes without departing from the spirit or essential characteristics thereof. Therefore, the present embodiments should be considered in all respects as illustrative and not restrictive of the scope of the invention as defined by the appended claims.

I claim:

1. A device for improving the performance of a golfer, particularly the repetitive correct swinging of the club, comprising:

a housing for mounting on a standard golf club shaft and containing first and second directional gyros each driven by a respective electrical motor, said first and second gyros having their axes normal to each other with one axis lying in the plane of swing of the club and the other with its axis normal to said plane, sensor means responsive to each of said gyros, alarm means responsive to the sensor means, and an electrical power source connected to each said motor, said sensing and said alarm means;

whereby an alarm is given when a golfer swings the club along a path outside that of the directional gyro's predetermined and set rotating direction.

2. The device according to claim 1 wherein said device is mounted on a standard golf club shaft in place of a conventional head.

3. The device according to claim 1 further comprising means for attaching said device to the head or shaft of any standard golf club.

4. The device according to claim 1 wherein said alarm means includes an audible alarm emitting a first sound when the club is swung too far from the golfer and a second sound when the club is swung too close to the golfer.

5. The device according to claim 4 wherein said audible alarm is transmitted to a headset worn by the golfer.

6. The device according to claim 4 wherein said audible alarm is transmitted via radio to a golf pro observing the golfer.

7. The device according to claim 1 wherein said alarm means includes a tactile alarm emitting a first vibration when the club is swung too far from the golfer and a second vibration when the club is swung too close to the golfer.

8. The device according to claim 1 wherein each said directional gyro comprises a heavy flywheel mounted for rotation within a frame, and means for angularly adjusting said frame.

9. The device according to claim 1 wherein one of said at least one gyros is oriented with its axis of rotation normal to the plane of the swing so that the flywheel is rotating in the plane of the swing.

10. The device according to claim 1 wherein one of said gyros is oriented with its axis of rotation normal to the plane of the swing so that the flywheel is rotating in the plane of the swing and the other gyro is oriented with its axis of rotation in the plane of the swing so that the flywheel is rotating normal to the plane of the swing.

11. A method for training a golfer to have the correct swing comprising:

providing a housing containing first and second directional gyros, sensing means responsive to said gyros, and alarm means responsive to the sensing means to give an audible and/or tactile alarm when the golfer's swing is outside that of the directional gyros' predetermined and set rotating directions, and a power supply connected to said gyros, said sensing means, and said alarm means.

* * * * *